United States Patent [19]

Lindström

[11] Patent Number: 4,947,671

[45] Date of Patent: Aug. 14, 1990

[54] DEVICE FOR MANUFACTURING CONICAL POLES

[76] Inventor: Wictor C. O. Lindström, P.O. Box 208, Furulund, Sweden, S-244 02

[21] Appl. No.: 379,360

[22] Filed: Jul. 13, 1989

[30] Foreign Application Priority Data

Jul. 15, 1988 [SE] Sweden ..... 8802645

[51] Int. Cl.[5] ..... B21D 5/08; B21D 5/12

[52] U.S. Cl. ..... 72/181; 72/52

[58] Field of Search ..... 72/51, 52, 177, 178, 72/179, 181; 228/17, 17.5

[56] References Cited

U.S. PATENT DOCUMENTS

| | | | |
|---|---|---|---|
| 3,234,704 | 3/1962 | Burgess et al. | 52/731 |
| 3,602,029 | 8/1971 | Burke | 72/181 X |
| 3,903,723 | 9/1975 | Colbath | 72/178 |
| 4,487,046 | 12/1984 | Abbey | 72/52 |

FOREIGN PATENT DOCUMENTS

| | | |
|---|---|---|
| 1814942 | 8/1969 | Fed. Rep. of Germany . |
| 1538955 | 1/1979 | United Kingdom . |

*Primary Examiner*—E. Michael Combs

*Attorney, Agent, or Firm*—Bacon & Thomas

[57] ABSTRACT

The present invention relates to a device for manufacturing conical poles or conical pole members by roll forming sheet metal wherein said device (1) includes a conveyor path (5) along which sheet metal is transported, and a plurality of groups (10) of forming rolls (11, 12) positioned in succession along the conveyor path (5). In order to facilitate the roll forming and eliminate the risk of bending the sheet metal during the roll forming, the forming rolls (11, 12) in at least one of the groups (10) thereof are mounted on frame members (13) which are pivotable about vertical axes (26) such that the forming rolls (11, 12) can be set to run at angles ($\alpha$ or $\beta$) relative to the center line (6) of the conveyor path (5) necessary to achieve a desired conical form of the finished pole or pole member or portions thereof.

3 Claims, 8 Drawing Sheets

DEVICE FOR MANUFACTURING CONICAL POLES

BACKGROUND OF THE INVENTION

1. Field of the Invention

The present invention relates to a device for manufacturing conical poles or conical pole members by roll forming sheet metal, said device comprising a conveyor path along which sheet metal is transported, and a plurality of groups of forming rolls positioned in succession along the conveyor path, whereby one or more forming rolls in a group are provided on one side of a longitudinal center line of the conveyor path and one or more forming rolls in the group are provided on the other side of said center line.

2. Description of the Related Art

From the GB patent specification 1 538 955 it is already known to utilize roll forming for manufacturing poles. The publication, however, does not define any device for manufacturing conical poles or pole members of great lengths, i.e. 15 m or more.

The U.S. patent specification No. 3,903,723 defines a roll forming device for manufacturing sheet metal details with conical portions. This prior art roll forming device however, is not intended for roll forming long, conical poles, where great precision is required and where a small setting error is enlarged many times because of the great length of the poles. The prior art roll forming device further does not permit e.g. outer portions of the poles to be provided with longitudinal edges with a certain conical form, while e.g. inner longitudinal edges extend with another conical form. Furthermore, after having manufactured poles with a certain conical form, the prior art device does not permit quick and simple resetting thereof for manufacturing poles with another conical form.

SUMMARY OF THE INVENTION

The object of the present invention is to provide a device for manufacturing conical poles or pole members of great lengths.

While the device according to the invention permits inclination of the forming rolls as defined and while the degree of inclination may vary, it is ensured that the forming is exact and without shearing stresses in the material to be formed. Additionally, different portions of the poles can be given different conical forms and after the manufacture of poles or pole members with a certain conical form, the device is simply and quickly reset for manufacturing poles or pole members with another conical form.

BRIEF DESCRIPTION OF THE DRAWINGS

The invention will be further described below with reference to the accompanying drawings, in which.

DETAILED DESCRIPTION OF THE PREFERRED EMBODIMENT

Figure 11:
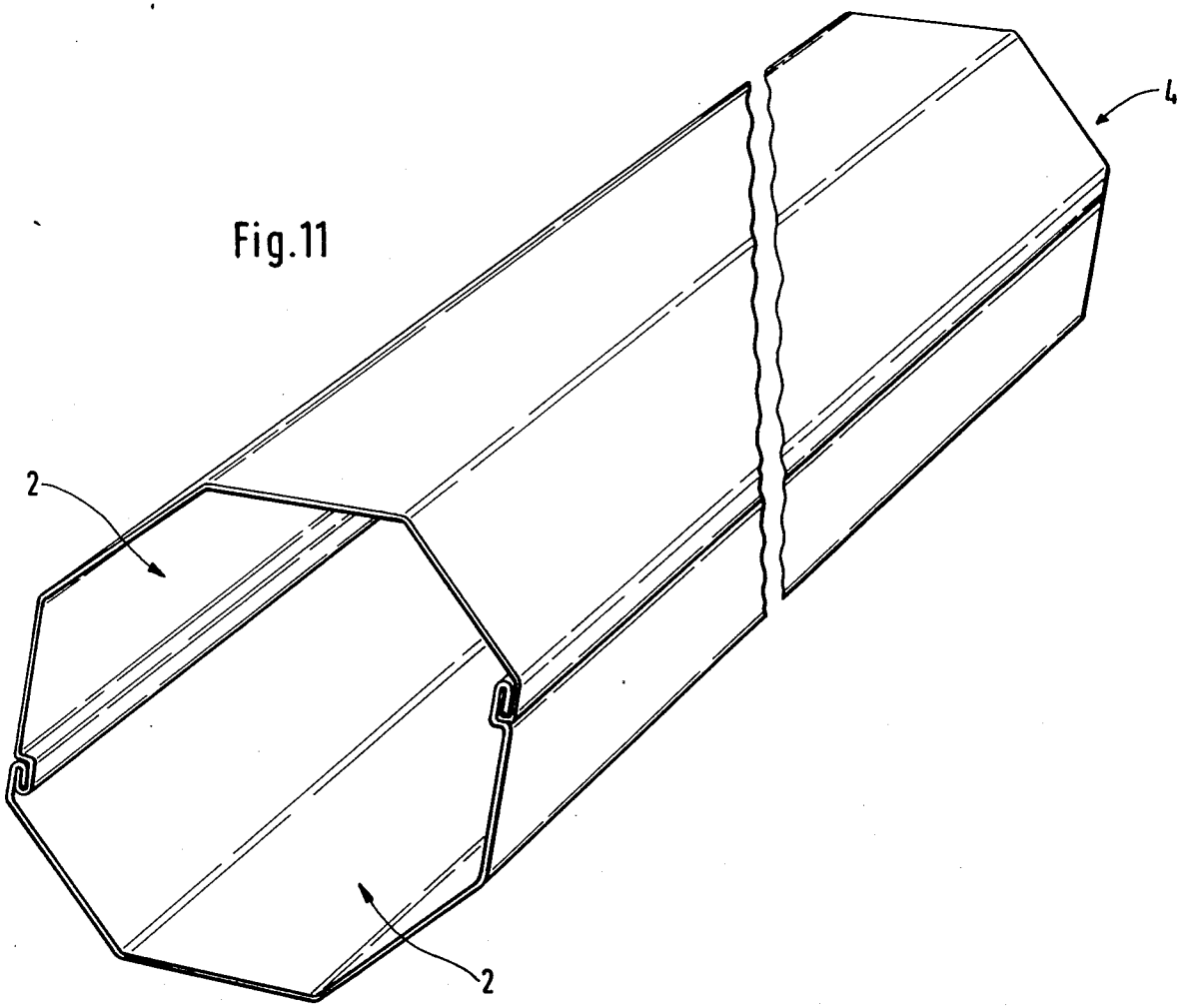
FIG. 11 is a perspective view of a pole consisting of two pole members according to FIG. 10.

The device 1 illustrated in the drawings is adapted for manufacturing conical pole members 2 by roll forming sheet metal 3. Said pole members are interconnected to form conical poles 4 (FIG. 11).

Figure 7:
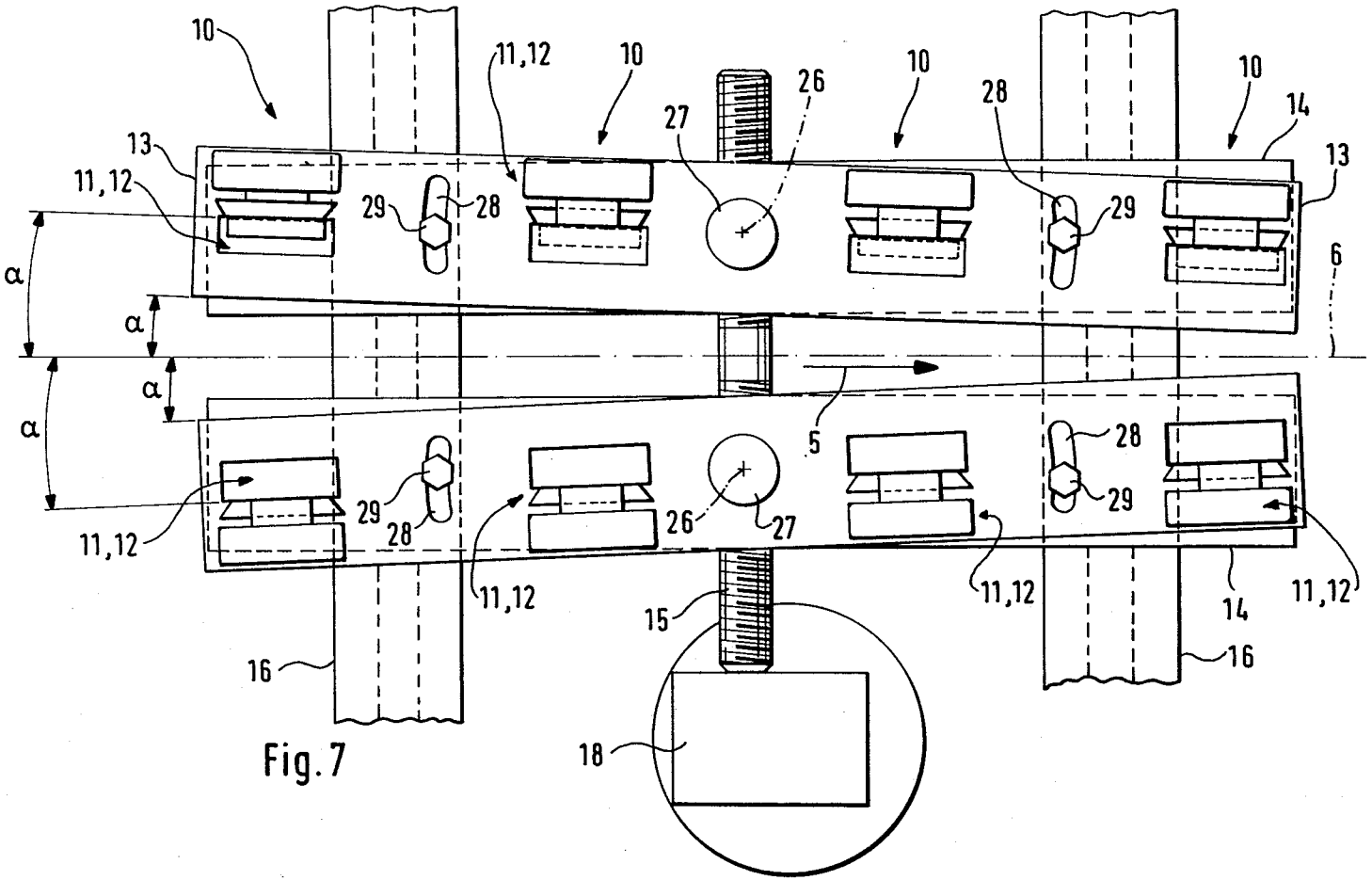
FIG. 7 is a top plan view of the roll forming station of FIG. 6.
Figure 8:
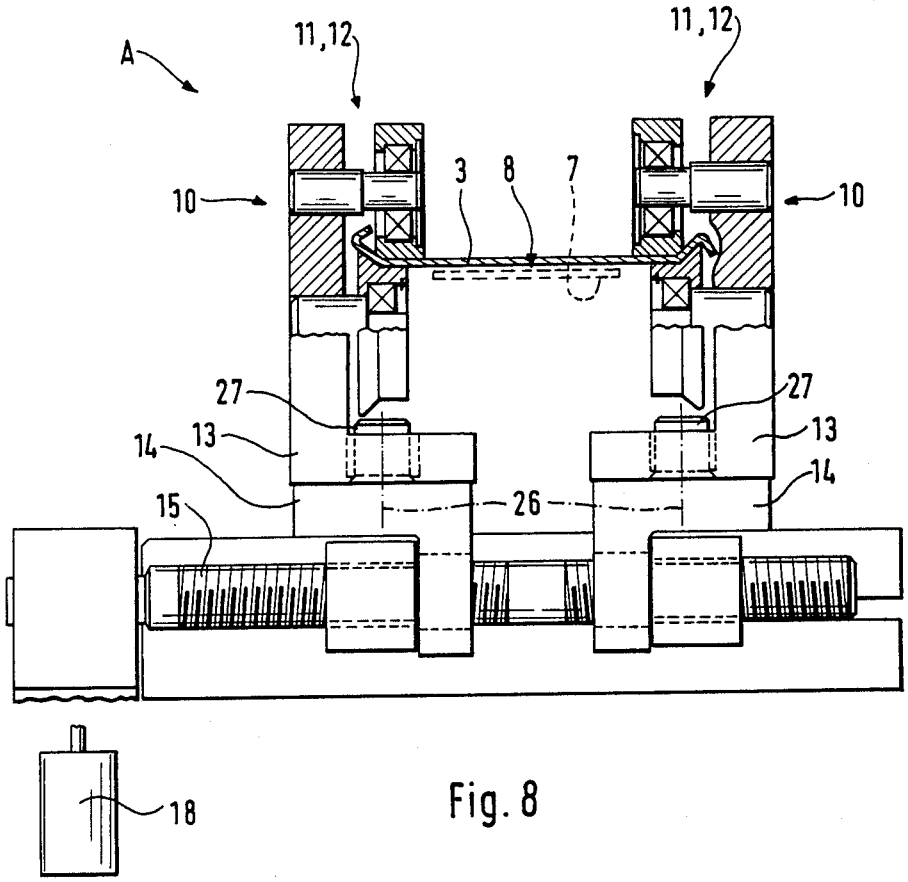
FIG. 8 is a cross section of the roll forming station of FIG. 6.
Figure 9:
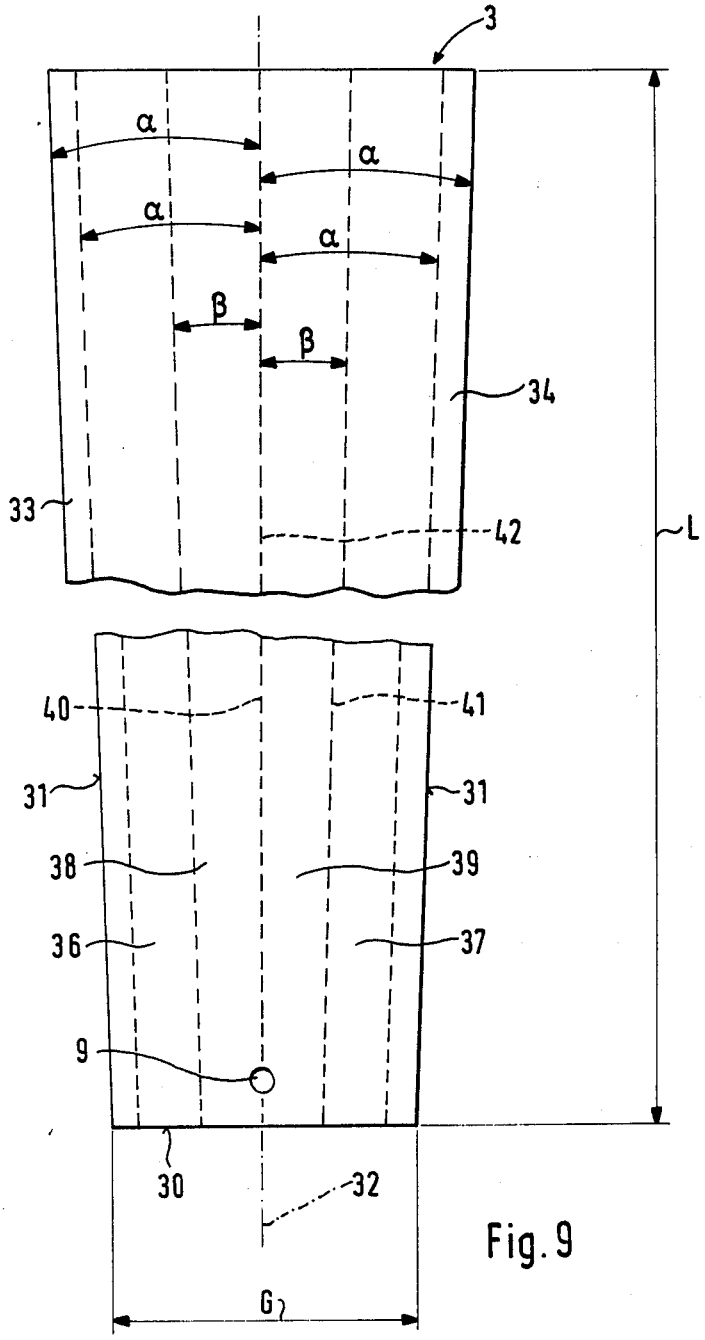
FIG. 9 is a plan view of sheet metal prepared for manufacturing a pole member.

For roll forming the pole members 2, the device 1 comprises a conveyor path 5, the longitudinal center line of which is designated 6 (FIG. 7). The transport of the sheet metal 2 along the conveyor path 5 is made by a conveyor chain 7 with grip means 8 which are inserted into holes 9 in the sheet metal 3 (FIG. 9).

A number of roll forming stations A, B and C are provided along the conveyor path 5. The illustrated device has three such stations. The roll forming station A has in this embodiment four successive groups 10 of forming rolls. At least one and preferably two forming rolls 11, 12 in each group 10 are provided on one side of the longitudinal center line 6, while at least another and preferably two other forming rolls 11, 12 in the same group are provided on the other side of the longitudinal center line 6.

The forming rolls 11, 12 on one side of the longitudinal center line 6 are movable towards said center line 6 at the same time as the forming rolls 11, 12 on the other side of the longitudinal center line 6 also are movable towards said center line 6. Furthermore, the forming rolls 11, 12 on one side of the center line 6 are movable from said center line at the same time as the forming rolls 11, 12 on the other side of the center line 6 also are movable from said center line 6. This pattern of movement is obtained while the forming rolls 11, 12 on each side of the center line 6 are provided on a frame member 13, which in turn is mounted on a lower part 14 of the frame, and these lower parts 14 cooperate with a rotatably mounted double screw 15. This screw includes a right-threaded portion which cooperates with one of said lower parts 14 of the frame, and a left-threaded portion which cooperates with the other lower part 14 of the frame. In order to control the lower parts 14 of the frame during their movements from and towards the center line 6, said lower parts cooperate with one or more guide rails 16.

The following roll forming station B is constructed in the same way as the roll forming station A, but has in this embodiment only three groups 10 of forming rolls 11, 12 instead of four.

The third roll forming station C is provided for forming a central corner in the sheet metal 3 and it therefore includes two groups 10 of forming rolls 11, 12 which are not movable from/to the center line and mounted such that they can form said corner along this center line 6.

Figure 5:
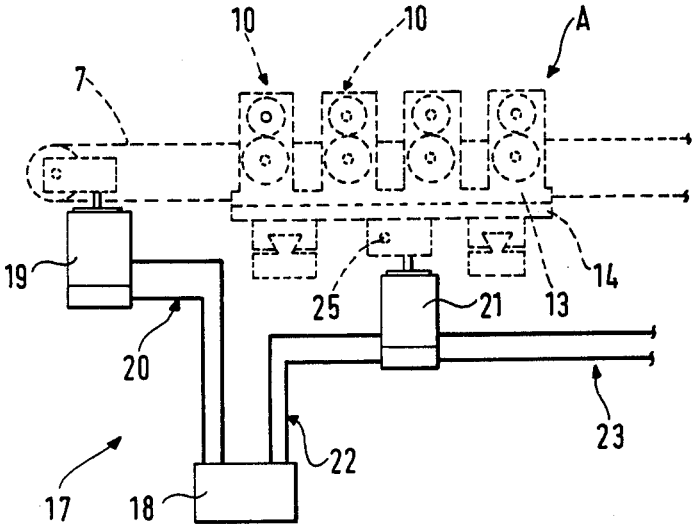
FIG. 5 schematically shows a control system for controlling the device of FIG. 1.

A control system 17 for controlling the moveable members of the device is known schematically in FIG. 5. This control system 17 includes a control unit 18 which is connected to the drive aggregate 19 of the conveyor chain 7 through conduits 20, to the drive aggregate 21 of the double screw 15 through conduits 22 and through conduits 23 to a drive aggregate 24 for a double screw 25 on the roll forming station B. The control system 17 is provided to operate the various drive aggregates 19, 21, 24 at such speeds that the sheet metal 3 takes the appropriate conical form.

In order to e.g. facilitate roll forming and substantially eliminate the risk of subjecting the sheet metal to flexural/tensile stresses or shearing stresses at the various stations, each frame member 13 is pivotable about a vertical axis 26. It is therefore possible to set the frame members 13 and thus, the forming rolls 11, 12 at such angles $\alpha$ relative to the center line 6 of the conveyor path 5 so that the desired conical form may be achieved for the finished pole member 2 or portions thereof.

Figure 6:
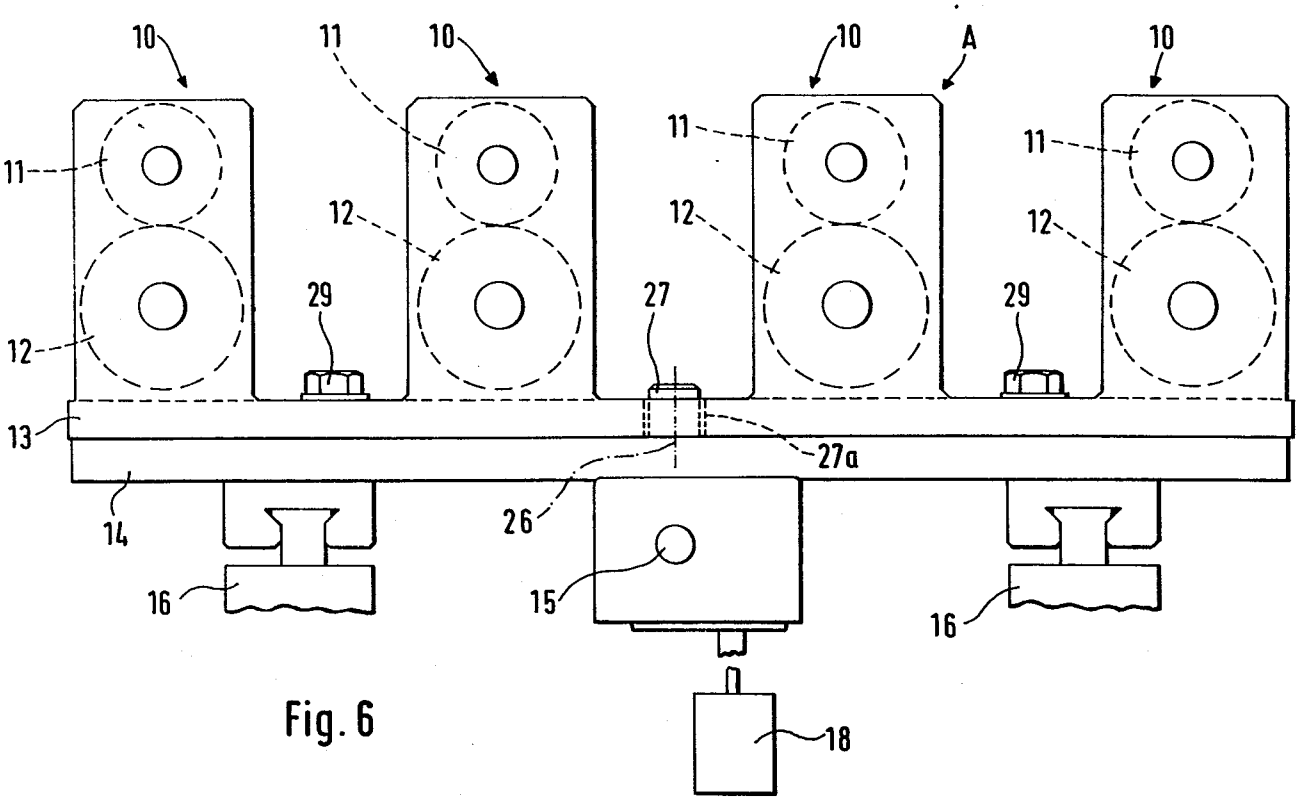
FIG. 6 is a side view of a roll forming station forming part of the device of FIG. 1.

Turning to FIG. 6, the vertical axis 26 may be defined by a pivot 27 which is mounted on the lower part 14 of the frame and protrudes into a recess 27a in the frame member 13. The axis 26 about which the frame member 13 is pivotable may, however, be designed in another way—the frame member 13 may e.g. have a depending pivot which protrudes into a recess in the lower part 14 of the frame.

As shown in FIG. 7, each frame member 13 has two arcuate long-holes 28, the arcs of which are centered with the axis 26. Locking means in the form of manually tightenable bolts 29 which are threaded in the lower part 14 of the frame are mounted in said long-holes 28. When the frame members 13 and thus, the forming rolls 11, 12 are set in their predetermined angular positions $\alpha$ relative to the center line 6, the bolts 29 are tightened, whereby the positions of the frame members 13 are fixed relative to the lower parts 14 of the frame. If the frame members 13 have an elongate shape as is shown in FIG. 7, the axes 26 are preferably provided centrally in the frame members 13 and one or more long-holes 28 are provided at substantial distances from said axes 26.

At the roll forming station B there is a corresponding axis 26 about which the frame members 13 are pivotable, as well as corresponding long-holes 28 and bolts 29 as in the roll forming station A, i.e. the frame members 13 in the roll forming station B are also settable in various angular positions relative to the center line 6 of the conveyor path 5.

Figure 10:
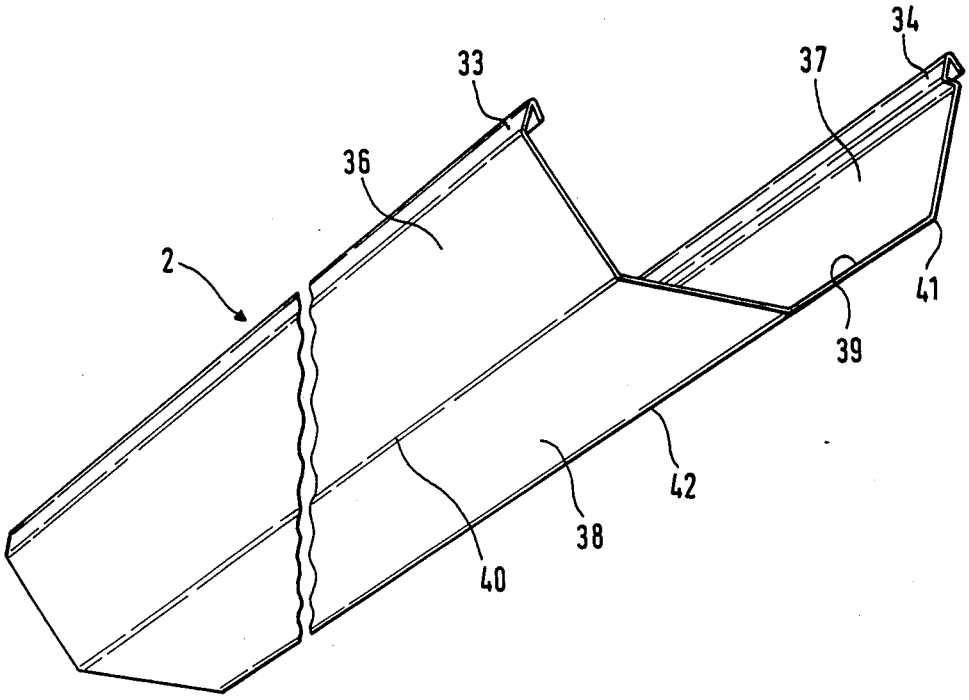
FIG. 10 is a perspective view of a pole member formed of the sheet metal material of FIG. 9.

In FIG. 9 a sheet metal blank 3 is illustrated, which blank is to be roll formed in the device 1 to a four-sided pole member 2 of the type shown in FIG. 10. By way of example, the length L of the sheet metal 3 (=length of the pole 4) is 15 m and its width G at the shortest end side 30 is 0.2 m. The sheet metal 3 is cut in such a way that each of its longitudinal sides 31 extend at an angle $\alpha$ of 0.5° relative to the longitudinal center line 32 of the sheet metal 3. Connecting portions 33, 34 are to be formed along the sheet metal 3 at station A, said portions being adapted to permit interconnection of two pole members 2 to form a pole 4. The connecting portions 33, 34 are to be roll formed along lines 35 running parallel with the long sides 31, i.e. at an angle $\alpha$ of 0.5° relative to the center line 32.

Four sides 36, 37, 38, 39 are also to be formed along the sheet metal 3, the corners of which run along lines 40, 41 and 42. The corners along the lines 40 and 41 shall run at an angle $\beta$ of 0.25° relative to the center line 32 and the corner along the line 42 shall run in the center line 32.

Before this sheet metal 3 is fed into the device 1, the control system 17 is programmed such that the connecting portions 33, 34 are formed at the station A with an angle $\alpha$ of 0.5°. The sides 36, 37 with the corners running along the lines 40, 41 are formed at the station B with an angle $\beta$ of 0.25° and the corner along the line 42 is formed at the station C. Before forming starts, the frame members 13 at the station A are pivoted about their axes 26 until the forming rolls 11, 12 mounted thereon extend at an angle $\alpha$ of 0.5° relative to the center line 6 of the conveyor path 5, whereafter the frame members 13 are fixed by means of the bolts 29. The frame members 13 at the station B are pivoted until the forming rolls 11, 12 mounted thereon extend at an angle $\beta$ of 0.25° relative to the center line 6 of the conveyor path 5. The sheet metal 3 is thereafter fed along the conveyor path 5 in the device 1 by means of the conveyor chain 7 and with its center line 32 centered with the center line 6 of the conveyor path 5. When the sheet metal 3 has passed the station C and leaves the device 1, it is completely formed into a pole member 2 according to FIG. 10. Two such pole members 2 are thereafter interconnected to form a pole 4 in a suitable manner.

If one wishes to manufacture pole members 2 with another conical form, i.e. with angles $\alpha$ than 0.5° and angles $\beta$ than 0.25° in the device 1, the control system 17 is easily reprogrammed and the angular positions $\alpha$ and $\beta$ of the frame members 13 quickly altered by loosening the bolts 29, pivoting the frame members 13 about the axes 26 and again tightening the bolts 29. Since the great lengths of the poles normally required the angles $\alpha$ and $\beta$ to be set exactly. a setting device (not shown) with a micrometer scale is preferably used. The setting of the angles $\alpha$ and $\beta$ of the frame members 13 may also be carried out mechanically instead of manually.

Figure 1:
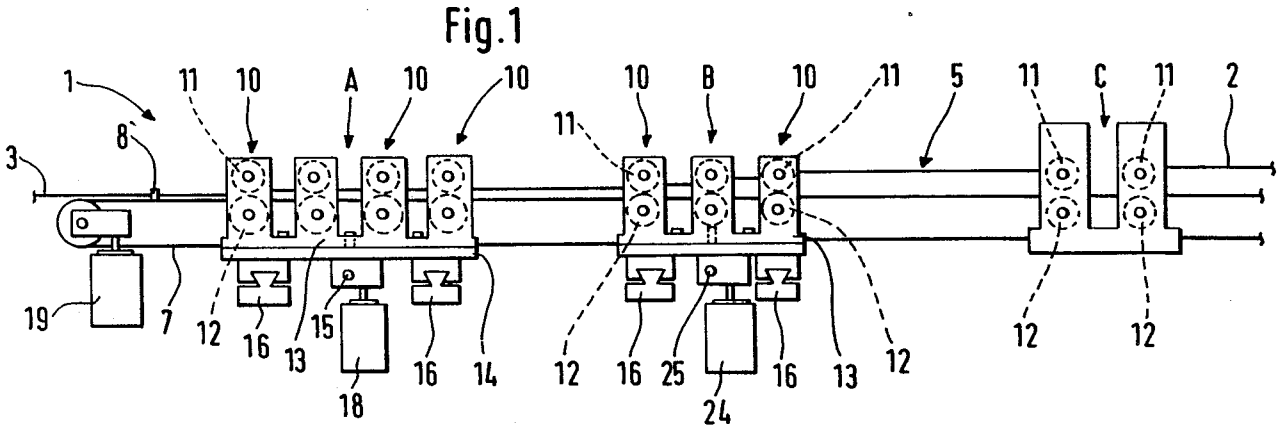
FIG. 1 is a side view of a schematically illustrated device according to the invention.
Figure 4:
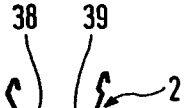
FIGS. 2–4 are cross sectional views of the sheet metal material as said material is formed in the device of FIG. 1.
Figure 3:
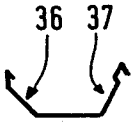
Figure 2:
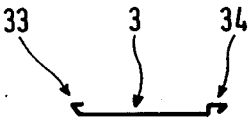

The pole 4 shown in the drawings and described above has eight sides and its members 2 are preferably made by means of a device 1 having three stations as shown in FIG. 1. An important advantage with the device is that it is easily resettable for manufacturing poles with another number of sides, e.g. six-sided poles (whereby e.g. only two stations are required), ten-sides poles (whereby e.g. three stations are sufficient) and twelve-sided poles (whereby e.g. four stations are needed).

The invention is not limited to the device illustrated in the drawings and described above, but may vary within the scope of the following claims. As an example of alternatives not described above, it can be mentioned that it is possible with the above device to form poles consisting of only one pole member instead of two or of another suitable number of pole members which are interconnected. Each station in the device may include one or more groups of forming rolls; there may be one or more locking means for fixing the frame members 13 in their angular positions; said locking means need not be bolts; and instead of a conveyor chain, another suitable transport device may be utilized for transporting the sheet metal.

I claim:

1. A device for manufacturing a conical pole member by roll-forming sheet metal, comprising:

a conveyor path along which said sheet metal is transported; and a plurality of roll-forming groups provided on either side of a longitudinal center line defined by said conveyor path, each said roll-forming group one one side being displaceable towards and from each other roll-forming group during roll formation and including at least one forming roll pivotably mounted on a frame member, wherein at least first and second of said roll-forming groups on one said side are pivotably mounted about an axis substantially perpendicular to said longitudinal center line and at respective desired angular positions so that said first group roll-forms sheet metal conveyed thereto at the first angle relative to said center line, and said second group roll-forms sheet metal conveyed thereto at a second angle relative to said center line, said first angle being variable relative to said second angle.

2. A device for manufacturing conical pole members as claimed in claim 1, wherein all forming rolls set at a common angle on the same side of the center line are pivotably mounted to a common frame member.

3. A device for manufacturing a conical pole member as claimed in claim 1, further comprising manually operable locking means for locking said frame members in said angular positions.

* * * * *